US005875597A

United States Patent [19]

Gingrich et al.

[11] Patent Number: 5,875,597

[45] Date of Patent: Mar. 2, 1999

[54] HEIGHT-ADJUSTABLE SPACE-DIVIDING SCREEN

[75] Inventors: Bryan Gingrich, Holland; David Fik, Hudsonville; Keith Foco, Holland, all of Mich.

[73] Assignee: Haworth, Inc., Holland, Mich.

[21] Appl. No.: 870,131

[22] Filed: Jun. 6, 1997

[51] Int. Cl.[6] ..... A47G 5/00; E04B 2/74

[52] U.S. Cl. ..... 52/239; 160/24; 160/135

[58] Field of Search ..... 52/126.3, 239, 52/481.2; 160/24, 135, 351, 352; 256/1, 24

[56] References Cited

U.S. PATENT DOCUMENTS

| | | | |
|---|---|---|---|
| 1,706,388 | 3/1929 | Ashkenas | 160/135 |
| 2,210,652 | 8/1940 | Dennett . | |
| 3,187,761 | 6/1965 | De Maio | 160/135 |
| 3,220,464 | 11/1965 | Wise | 160/24 |
| 3,425,171 | 2/1969 | Propst et al. . | |
| 3,592,289 | 7/1971 | Aysta . | |
| 3,596,701 | 8/1971 | Cowan . | |
| 3,659,389 | 5/1972 | Forberg . | |
| 3,889,736 | 6/1975 | Firks . | |
| 3,987,838 | 10/1976 | LaGue et al. | 52/239 X |
| 4,047,342 | 9/1977 | Boulva . | |
| 4,070,006 | 1/1978 | Storie | 256/24 X |
| 4,103,465 | 8/1978 | McDonald, Jr. . | |
| 4,408,430 | 10/1983 | Wangler et al. . | |
| 4,601,145 | 7/1986 | Wilcox . | |
| 4,638,614 | 1/1987 | Wilcox . | |
| 4,874,027 | 10/1989 | Boundy et al. . | |
| 4,969,500 | 11/1990 | Makosa | 160/135 |
| 5,050,846 | 9/1991 | Goodman et a. | 256/1 |
| 5,207,260 | 5/1993 | Commesso | 160/351 X |
| 5,213,312 | 5/1993 | MacDonald . | |
| 5,272,848 | 12/1993 | Maas . | |
| 5,339,576 | 8/1994 | Fussler . | |
| 5,486,391 | 1/1996 | Tyner . | |
| 5,502,930 | 4/1996 | Burkette et al. . | |
| 5,689,926 | 11/1997 | Nichols | 52/239 X |
| 5,758,868 | 6/1998 | Shea | 256/24 X |

OTHER PUBLICATIONS

Portable Privacy Station brochure, Blood Systems, Inc., (3 pages).

The Right Carpet Backing brochure, Colback (3 pages).

Ball & Spring Plungers article, Design Standards (1 page).

The Elasticity of Rubber article, Isao Hosoe, 1984 (1 page).

*Primary Examiner*—Christopher Kent

*Assistant Examiner*—Timothy B. Kang

*Attorney, Agent, or Firm*—Flynn, Thiel, Boutell & Tanis, P.C.

[57] ABSTRACT

A space-dividing screen assembly comprising a pair of height-adjustable support posts and a flexible fabric screen having the opposite ends thereof connected to the support posts. The support posts include vertically movable outer tubes to which the opposite ends of the screen are connected. Vertical movement of the outer tubes permits adjustment of the height of the screen. The outer tube is rotatable so as to allow winding up of the flexible fabric onto the outer surface of the outer tube. Also, additional screens can be suspended from the support posts while the opposite free ends of the screens are supported by additional support posts to provide a readily adjustable privacy screen arrangement.

19 Claims, 7 Drawing Sheets

HEIGHT-ADJUSTABLE SPACE-DIVIDING SCREEN

FIELD OF THE INVENTION

This invention relates to an upright space-dividing privacy screen arrangement such as is used in offices and the like, and more particularly relates to an improved privacy screen arrangement which is adjustable so as to selectively vary both the height and length of the privacy screen.

BACKGROUND OF THE INVENTION

Upright space-dividing screen arrangements are well known for use in commercial and office environments, and numerous variations of such arrangements have been developed. Most known upright space-dividing screen arrangements, however, have been developed solely for the purpose of functioning as a privacy divider between adjacent work areas. Accordingly, many such screen arrangements are often heavy, bulky and are not readily movable or transportable.

Further, such screens typically are rigid in that they use rigid panels and frames which have a fixed height and cannot be bent to the shape of the work areas. Such rigid panel and frame arrangements typically use additional rigid screens, panels or frames which are joined together to vary the height, length or shape of the wall being formed by the screen components. As a result, such divider screen arrangements require additional time and effort to vary the configuration thereof. While not all screen arrangements suffer from such drawbacks, nevertheless many of these arrangements lack flexibility in modifying the divider screen to accommodate the varying requirements of an office space, which requirements can change over time.

It is an object of this invention to provide an upright space-dividing screen arrangement developed particularly for use in office and commercial environments, which screen arrangement provides a higher degree of flexibility than that provided by conventional, structurally rigid screens as described above.

In view of the foregoing, the divider screen assembly of the invention includes a pair of spaced apart upright telescoping support poles or posts which stand independently upon a floor, and a flexible fabric screen extending therebetween.

More particularly, the support poles include an inner tube supported on the floor and a hollow outer tube which is adapted to be slid onto the upper end of the inner tube. The outer tube thereby is positioned in telescoping engagement with the lower tube to permit adjustment of the overall height of the support poles.

The screen is formed of a flexible fabric and extends from one post to the other spaced apart post. The opposite ends of the fabric screen include vertical connector rods, the upper and lower ends of which are adapted to be removably engaged with the post. Once the connector rods are connected to the outer tubes so that the screen is supported thereby, the privacy screen assembly and in particular, the support poles can be placed where desired in a workstation area. The flexible screen extending therebetween serves to provide privacy to a workstation user. Since the screen is a flexible fabric, the distance between the two support posts can be adjusted without adjusting the length of the screen.

Further, the outer tube not only is vertically movable relative to the inner tube, but also can be rotated relative thereto. By rotating the outer tube relative to the inner tube, the screen can be wrapped around the periphery or circumference of the outer tube and rolled up to reduce the length between the two support posts.

Still further, each support post includes a plurality of angularly spaced apart mounting locations for the screen. Thus, additional flexible screens can be connected to each post so as to extend outwardly at different angular positions and further define the boundaries of the workstation areas. The free ends of these additional screens are themselves supported by additional support posts. Thus, one or more of the support posts can serve as a hub for a workstation area wherein several fabric screens are connected thereto. The opposite ends of the screens are positioned where desired by moving the additional support posts which support these additional screens. As a result, the divider screen assembly is fully adjustable and can be readily positioned for use.

Other objects and purposes of the invention, and variations thereof, will be apparent upon reading the following specification and inspecting the accompanying drawings.

Figure 1:
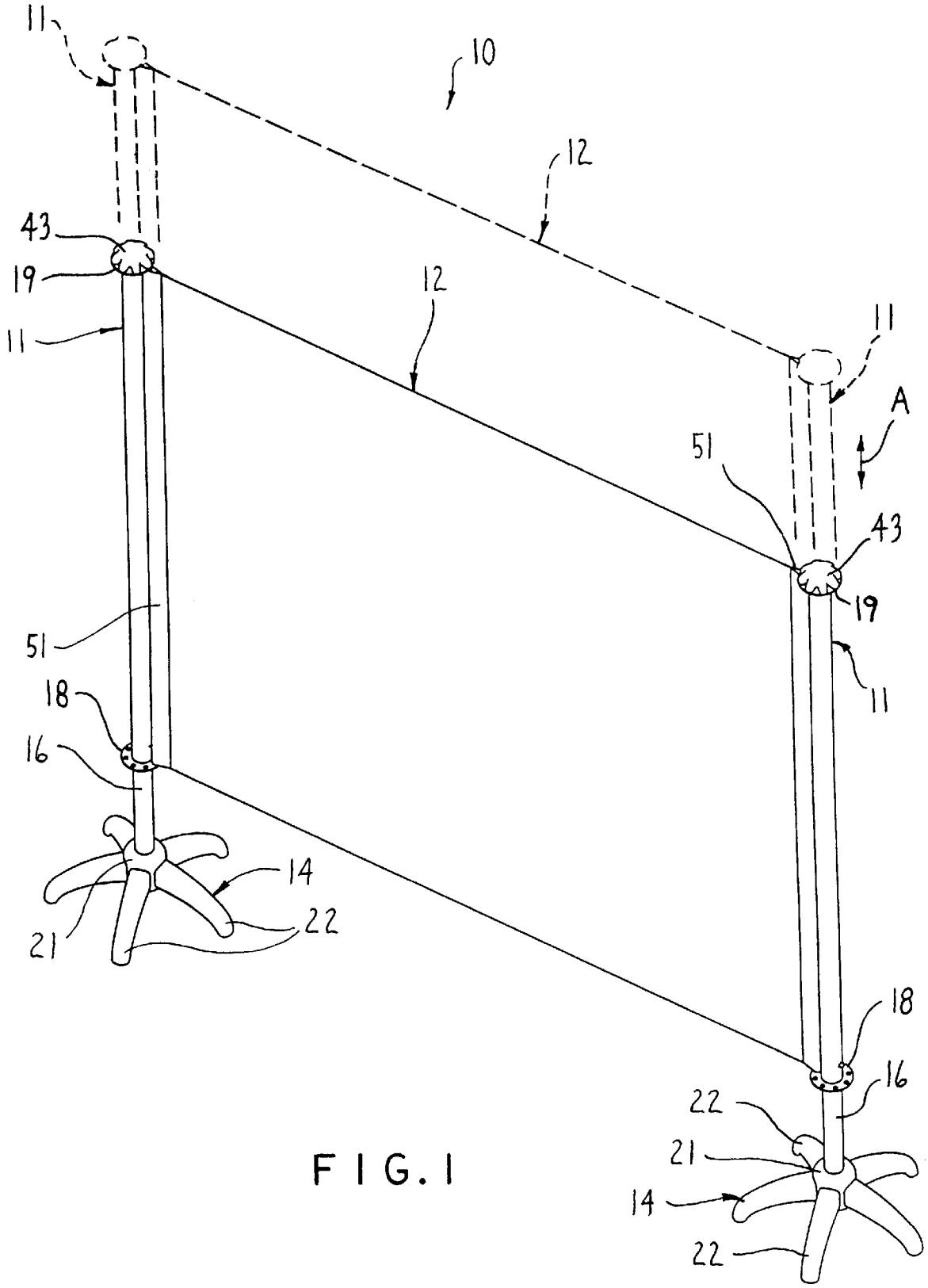
FIG. 1 is a front isometric view illustrating a space-dividing screen assembly of the invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Figure 2:
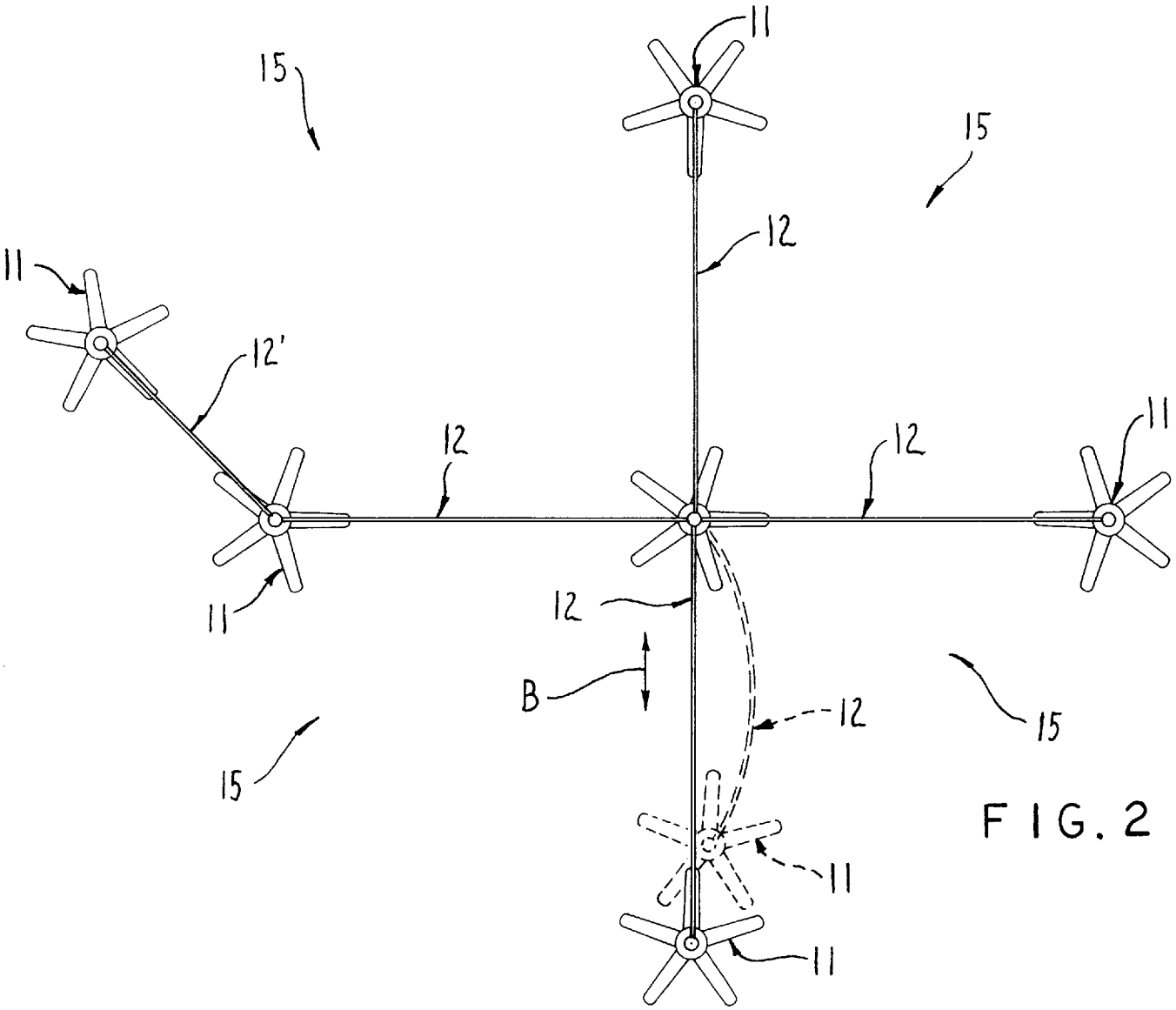
FIG. 2 is a top plan view of an arrangement of the divider screen assemblies defining several workstation areas.

Referring to FIGS. 1 and 2, the invention relates to a space-dividing privacy screen assembly 10 that includes a pair of upright support posts or poles 11 and a flexible screen 12 which is supported therebetween. Each post 11 is supported on a base 14.

Generally, each of the support posts 11 includes an upstanding inner tube 16 which projects upwardly above the floor and telescopingly supports a hollow outer tube 17 thereon. The opposite ends of the fabric screen 12 are connected to the outer tubes 17 of two spaced apart support posts 11.

Figure 6:
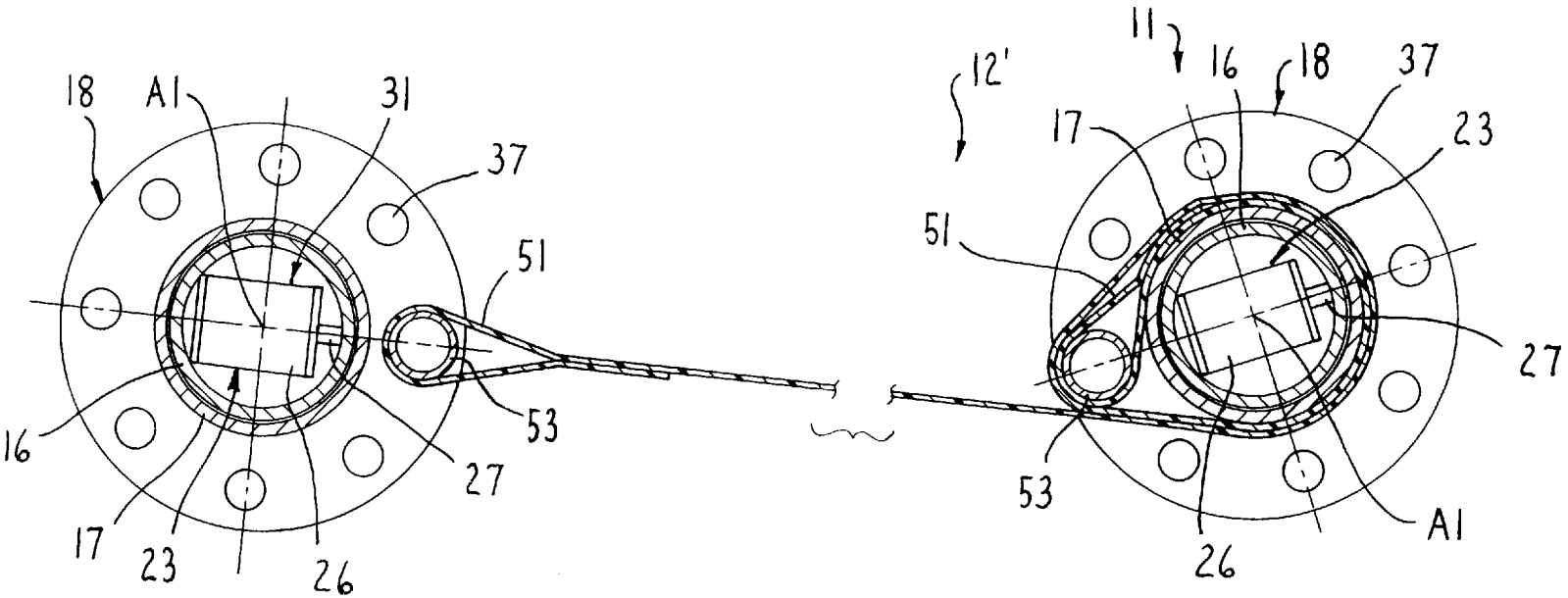
FIG. 6 is a cross-sectional view illustrating two support posts and the flexible screen engaged therewith as viewed in the direction of arrows 6—6 in FIG. 4.

To vary the arrangement of the workstation areas 15, the outer tubes 17 can be raised and lowered so as to adjust the overall height of the privacy screen assembly 10 (as shown in phantom outline in FIG. 1), or can be manually rotated to wind up the screen 12 thereon and adjust the distance between the two support posts 11 as generally indicated in FIGS. 2 and 6 by the wound-up screen 12'. Also, the flexibility of these screens 12 permits one support post 11 to be moved to any selected position relative to the other support post 11 so as to further vary the boundaries of the workstation areas 15. The posts 11 may be provided with casters which are positioned in rolling engagement with the floor, or glides to make it easier to move the support posts 11 to a new location.

To provide further flexibility, one or more privacy screen assemblies 10 are gangable together to subdivide the office area into the separated workstation areas 15. In particular, upper and lower mounting plates 18 and 19 as provided on each support post 11 are adapted to connect one or more fabric screens 12 thereto as shown in FIG. 2.

Thus, single screen assemblies 10 can be used individually for privacy, or groups of screen assemblies 10 can be ganged together to divide large office areas. As a result, the screen assembly 10 of the invention is readily adjustable and reconfigurable to accommodate the changing needs of an office.

Figure 3:
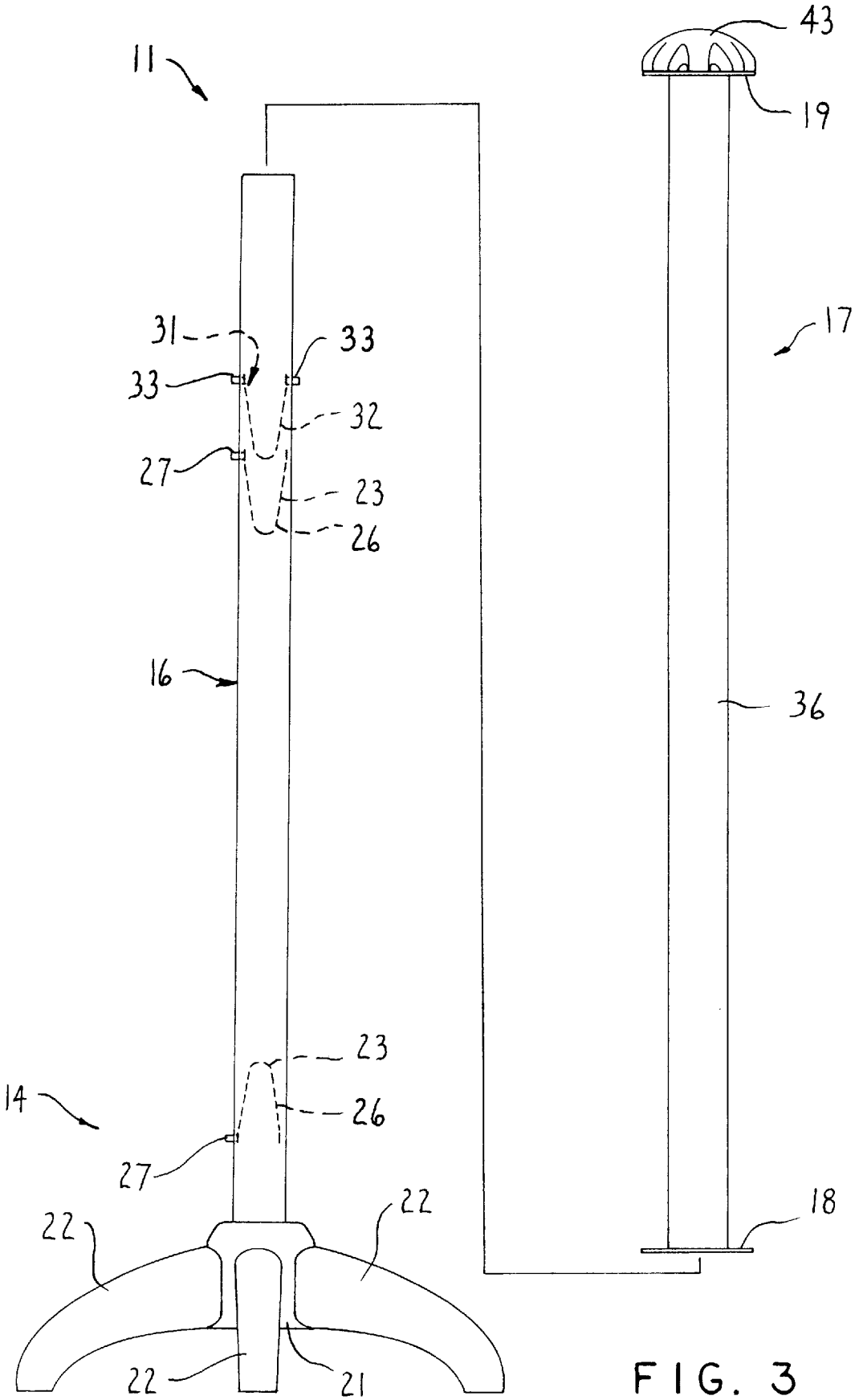
FIG. 3 is an exploded front elevational view illustrating inner and outer tubes of one of the support posts.

More particularly with respect to the screen assembly 10, the base 14 (FIGS. 1–3) of each of the support posts 11 is adapted to be supported on a floor in the office area. The base 14 includes a central hub 21 and a plurality of support legs 22 which project radially outwardly and downwardly from the hub 21.

The base 14 supports the elongate inner tube 16 thereon which has a lower end rigidly connected to the hub 21 and an upper free end which projects upwardly a substantial distance. Preferably, the inner tube 16 is a cylindrical hollow tube which is oriented vertically relative to the floor, and is formed of metal tubing or other suitable rigid material.

To support the outer tube 17 at different heights, the inner tube 16 includes a pair of single-pin spring clips 23 (FIGS. 3 and 4) which serve as stops along the inner tube 16 to support the bottom end of the outer tube 17. The two spring clips 23 are vertically spaced apart so as to define two different heights for the outer tube 17. Preferably, the higher height extends above eye level to provide privacy for a user who is standing, while the lower height provides privacy to a seated user although the user can stand to look over the top of the screen 12.

Figure 4:
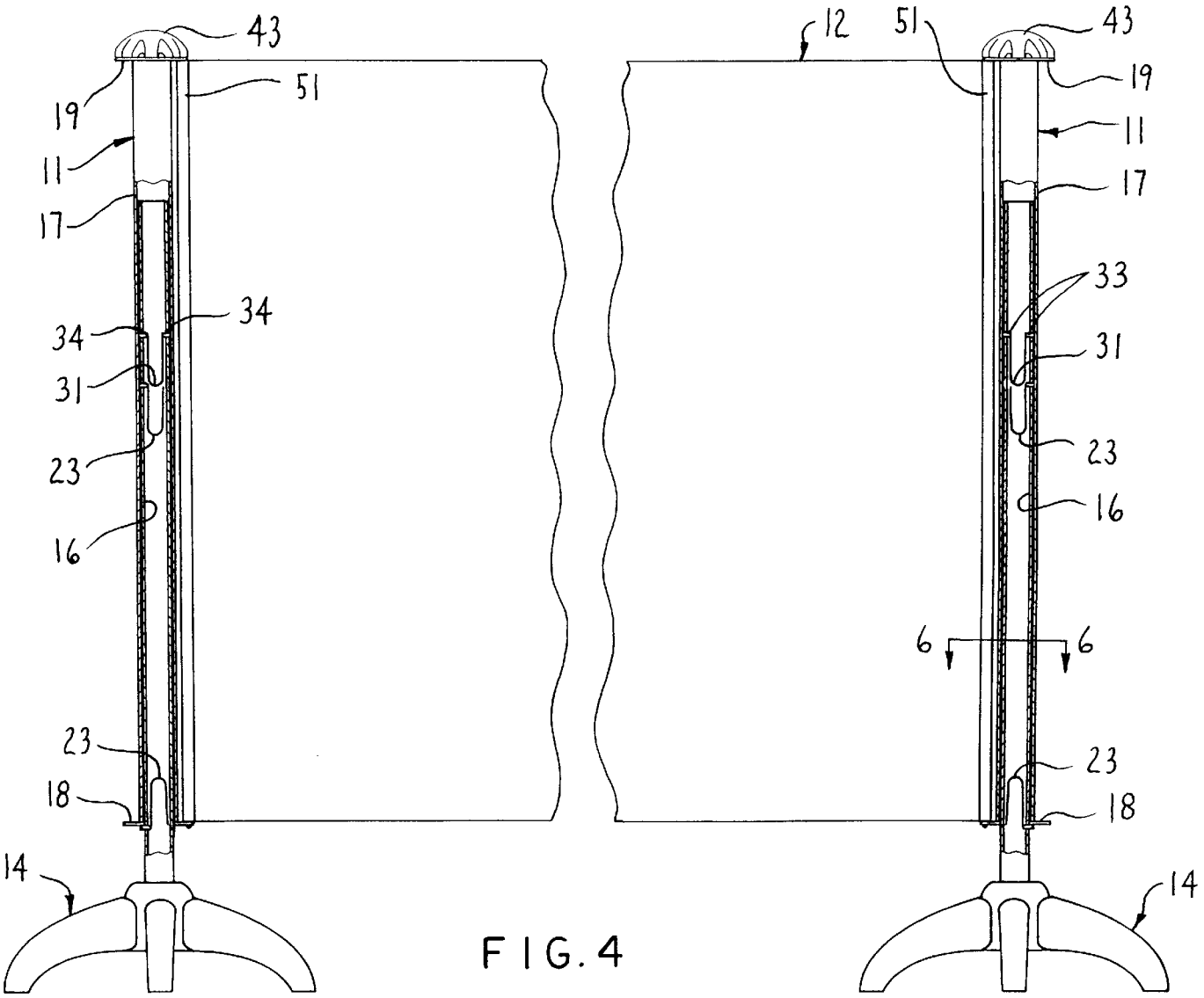
FIG. 4 is a fragmentary front elevational view in partial cross-section and illustrating the divider screen assembly of FIG. 1.
Figure 5:
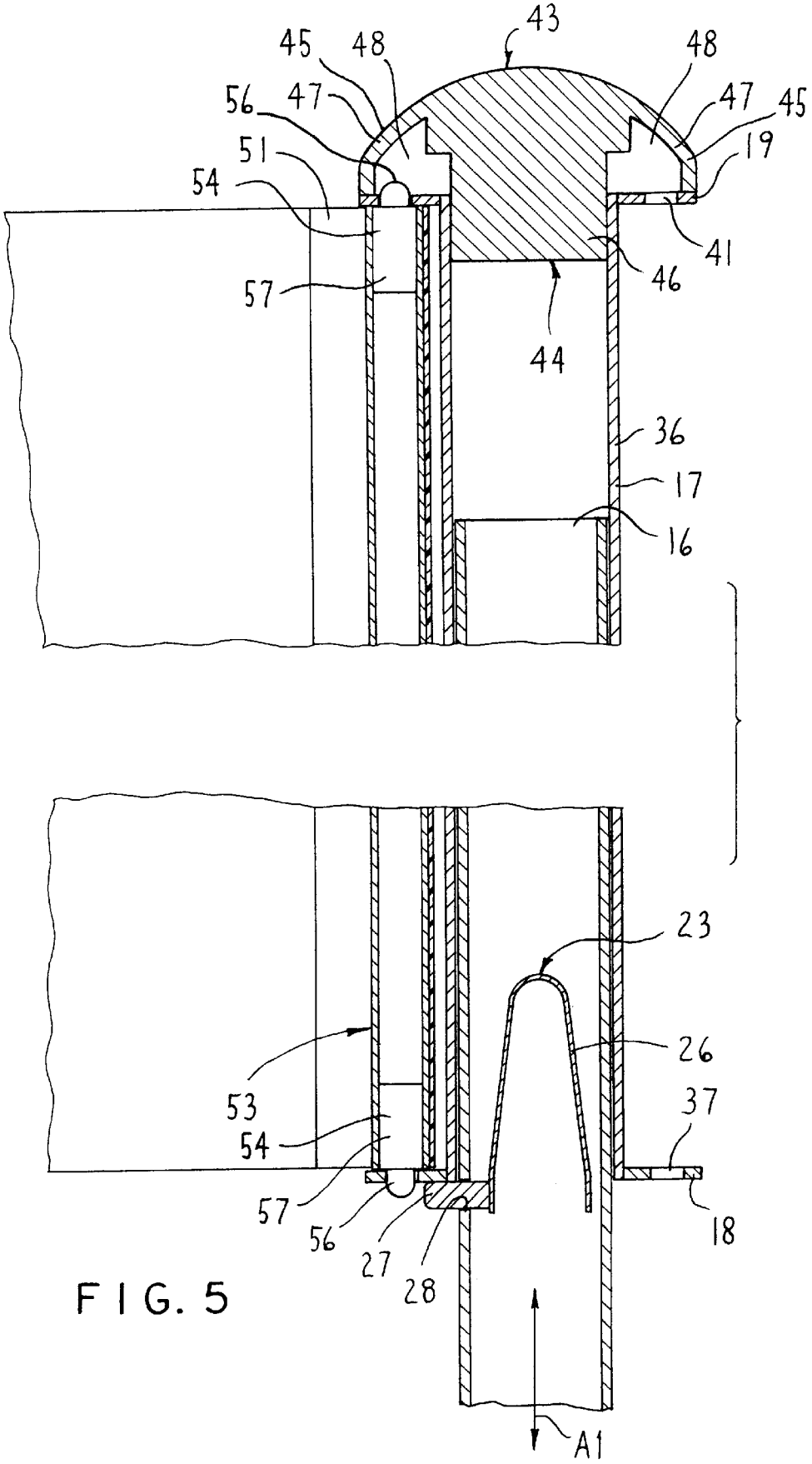
FIG. 5 is an enlarged partial front elevational view in cross-section and illustrating one of the support posts and a flexible screen attached thereto.

Each spring clip 23 includes a U-shaped spring section 26 which is formed of resilient spring steel and includes a pin 27 which is rigidly connected to one leg thereof. As seen in FIGS. 4 and 5, each of the spring clips 23 is inserted into the hollow interior of the inner tube 16 until the pin 27 thereof is slidably received through a corresponding hole 28 (FIG. 5) formed through the wall of the inner tube 16. The other leg of the spring section 26 acts on the interior surface of the inner tube 16 on the side opposite the pin 27 so as to bias the pin 27 outwardly through the hole 28.

If the outer tube 17 is located above the pin 27, the pin 27 serves as a stop to vertically support the outer tube 17 at the height defined thereby. However, when sliding the outer tube 17 onto the inner tube 16, the pin 27 is manually pressed inwardly into the hole 28 so as not to interfere with the outer tube 17 as it is slid downwardly. Thereafter, the pin 27 is released and slides outwardly until it abuts against the inside surface of the outer tube 17 to permit movement thereof as described hereinafter.

The inner tube 16 also includes at least one double-pin spring clip 31 which is located just above the uppermost single-pin spring clip 23. The double-pin spring clip 31 includes a U-shaped spring section 32 which is formed substantially the same as the spring section 26 of the single-pin spring clip 23. However, the spring section 32 includes two pins 33 which are fixed to the free ends or legs thereof. The pins 33 are biased outwardly by the spring section 32 so as to normally extend through a pair of apertures 34 formed in the wall of the inner tube 16 and project radially outwardly from the outer surface thereof.

Preferably, the spring section 32 and the pins 33 are formed integrally with each other from a single elongate piece of spring steel which is bent to form the spring section 32 and shaped at its opposite ends to form the pins 33. The single-pin spring clip 23 is formed in a similar manner.

Similar to the single-pin spring clip 23, the pins 33 are manually pressed or in other words, pushed inwardly into the apertures 34 during mounting of the outer tube 17, and thereafter act against the interior surface thereof. Unlike the single-pin spring clips 23, however, the double-pin spring clip 31 is normally contained within the outer tube 17 when adjusting the height thereof. As a result, the double-pin spring clip 31 acts on the inside surface of the outer tube 17 and functions to limit or brake rotation of the outer tube 17 relative to the inner tube 16 due to the frictional contact therebetween.

With respect to the movable outer tube 17 (FIGS. 3–6), the outer tube 17 is formed from a hollow tubular section 36 which has a diameter slightly greater than the outside diameter of the inner tube 16 such that a lower open end thereof is slidable onto the top end of the inner tube 16. Since both of the inner and outer tubes 16 and 17 have circular cross-sections when viewed from above (FIG. 6), the outer tube 17 also is rotatable relative to the inner tube 16 about a substantially vertical axis of rotation A1.

As the outer tube 17 is slid downwardly toward the double-pin spring clip 31, the pins 33 on the opposite sides thereof are manually pressed inwardly to allow continued downward sliding of the outer tube 17. When the pins 33 are released, the pins 33 act outwardly on the inside surface of the outer tube 17 while still permitting rotation and vertical sliding thereof.

The outer tube 17 then is slid downwardly until it abuts against either the lowermost spring clip 23 or the uppermost spring clip 23, either of which acts as a stop or support member for setting the height of the outer tube 17. As seen in FIG. 5, the pin 27 of the lowermost spring clip 23 prevents downward sliding of the outer tube 17, but can be manually pressed inwardly for continued downward sliding of the outer tube 17 until it rests on the hub 21. As a result, the hub 21, lower spring clip 23, and upper spring clip 23 define respective lower, intermediate and upper heights for the outer tube 17.

While only three heights are defined in the preferred embodiment of the invention illustrated in FIGS. 1–7, the skilled artisan will appreciate that additional spring clips 23 can be provided on the inner tube 16 at any selected height or elevation so as to define additional predetermined heights for the screen 12. Still further, while the spring clips 23 are supported by the inner tube 16, the skilled artisan will also appreciate that the inner tube 16 instead could be provided with a row of vertically spaced apart apertures and the outer tube 17 provided with a pin (not illustrated) which can be readily inserted inwardly into any one of the apertures to define a stop for the outer tube 17.

When the outer tube 17 is supported at one of the lower, intermediate and upper screen heights, the pins 33 of the double-pin spring clip 31 project outwardly against the interior surface of the outer tube 17 in frictional engagement therewith. The outward pressing of the pins 33 accommodates play which typically is present since the inside diameter of the outer tube 17 is slightly greater than the outside diameter of the inner tube 16. Further, while the outer tube 17 can rotate relative to the inner tube 16, the frictional engagement of the pins 33 with the interior surface of the outer tube 17 serves to resist rotation thereof and effectively acts as a frictional brake to resist unwinding of the screen 12 when wound thereon.

To support the screen 12, the lower end of the outer tube 17 includes the lower mounting ring 18 which preferably is welded thereon. The lower mounting ring 18 extends circumferentially about the outer surface of the outer tube 17 and projects radially outwardly therefrom. As illustrated in FIG. 6, the lower mounting ring 18 includes a plurality and preferably eight bores or openings 37 which open vertically therethrough. The openings 37 preferably are angularly spaced apart from each other at an angular distance of approximately 45° so as to define a circular pattern or ring of holes. As described in detail hereinafter, each of the openings 37 defines a different mounting location for the end of the fabric screen 12.

The outer tube 17 also includes the upper mounting ring 19 which is secured to the top end thereof preferably by welding. The upper ring 19 is formed identical to the lower ring 18 in that it also includes a plurality and preferably eight openings 41 which open vertically therethrough. The openings 41 are circumferentially spaced apart at equal angular distances of approximately 45° and are vertically aligned with the openings 37 of the lower ring 18. Thus, each one of the openings 41 of the upper ring 19 is located directly above and is coaxially aligned with a corresponding one of the openings 37 of the lower ring 18 so as to define vertically-spaced pairs of openings which define eight mounting locations for the screen 12.

The posts 11 also include a plastic cap or knob 43 which mounts to the top end of the outer tube 17. The cap 43 serves to enclose the top end of the post 11 while at the same time providing a hand grip for manually rotating the outer tube 17.

Figure 7:
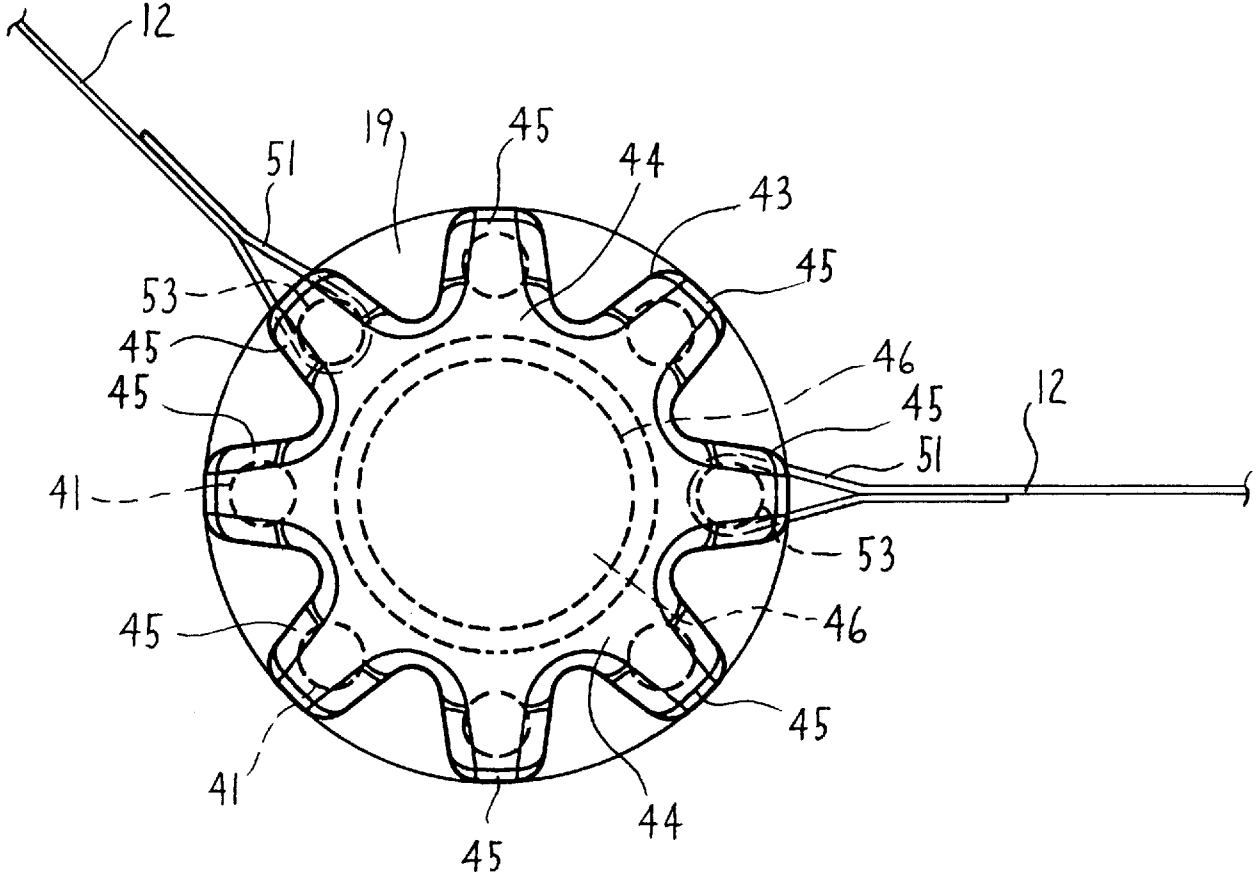
FIG. 7 is an enlarged partial top plan view of a support post of the divider screen assembly having two flexible screens engaged therewith.

Referring to FIGS. 5 and 7, the cap 43 has a star-shaped configuration that is defined by a central section 44, and eight radially projecting portions 45 which overlie the eight openings 41 of the upper ring 19. The central section 44 is defined by a downwardly extending cylinder 46 which is fixedly secured within the open top end of the outer tube 17. The cylinder 46 is formed coaxially with respect to the upper ring 19 and outer tube 17.

The radially projecting portions 45 extend radially outwardly from the cylinder 46 and are each defined by an exterior wall 47. The radially projecting portions 45 preferably define cavities 48 which open downwardly toward the openings 41 of the upper ring 19.

With respect to the screen 12, the screen 12 is formed of a thin sheet-like fabric which is sufficiently flexible in a longitudinal direction so as to permit bending, curving and winding up, and also is sufficiently stiff in a vertical direction so as to maintain its shape with little if any sagging when the support posts 11 are moved close together so as to cause horizontal bowing of the screen as shown in FIG. 2 in phantom outline. Also, the screen 12 is not transparent so as to provide privacy between adjacent workstations 15. The preferred fabric is a non-woven fabric sold under the registered trademark COLBACK by Akzo Nobel Non-wovens, Inc. of Enka, N.C.

The screen 12 has a rectangular shape and the opposite ends thereof are folded over to form hemmed sections 51 along the opposite vertical edges thereof. The hemmed sections 51 open from the top and bottom thereof.

To connect the opposite ends of the screen 12 to the respective support posts 11, each hemmed section 51 includes an elongate connector or mounting rod 53 which is slid vertically therethrough. The opposite ends of the connector rod project from the upper and lower ends of the hemmed section 51.

The connector rod 53 is a hollow tubular member having conventional spring plungers 54 seated in the opposite ends thereof. Each of the spring plungers 54 includes a retractable spring-urged ball or projection 56 which projects vertically from a spring-containing housing 57. The housing 57 is fixed in the open end of the connector rod 53 while the retractable projection 56 projects vertically therefrom.

The connector rod 53 is thereby engaged with the screen 12 and rigidly supports the hemmed sections 51 along substantially the entire vertical length of the screen end edges such that the end edges are rigid while the intermediate suspended section of the screen 12 remains unsupported. Preferably, the hemmed section 51 of the screen 12 also is free to swivel about the connector rod 53 to provide further flexibility in positioning the screens 12.

When connecting one end of the screen 12 to a selected one of the mounting locations, the connector rod 53 is inserted into the hemmed section 51 of the screen 12, and then is moved sidewardly into the region between the upper and lower mounting rings 18 and 19 until the retractable projections 56 snap into a selected pair of openings 37 and 41. The opposite end of the screen 12 is also connected to a second support post 11 in the same manner such that the screen 12 is suspended between a pair of support posts 11.

The screen 12 is sufficiently flexible so as to permit the support posts to be moved closer together as seen in FIG. 2 such that the screen 12 bows outwardly to vary the shape of the boundary of the workstation areas 15. While the screen 12 is flexible, it is also sufficiently stiff so as to permit movement of the support posts 11 closer together without significant sagging of the intermediate section of the screen 12.

It is also desirable to be able to reduce the distance between the support posts 11 while maintaining the screen 12 in a taut or generally linear condition as generally illustrated in FIGS. 1 and 2. Accordingly, the screen 12 is sufficiently flexible so as to be wrapped up or wound onto one of the support posts 11. In particular, a user can manually rotate the outer tube 17 by gripping the top cap 43 to wind up the fabric screen 12 onto the outer periphery thereof as generally seen on the rightward post 11 illustrated in FIG. 6. While only one of the outer tubes 17 is illustrated in FIG. 6 as being used to wind up the screen 12, it is also possible to wind the screen 12 onto both support posts 11.

Further, the screen 12 is vertically movable through movement of the outer tubes 17 of the support posts 11. Thus, to adjust the height of the screen 12, the outer tubes 17 are telescoped upwardly and downwardly so as to be supported at a selected height by one of the upper and lower spring clips 23 or the hub 21. Thus, the overall height of the privacy screen assembly 10 and in particular, the screen 12 is readily adjusted by raising and lowering the outer tubes 17.

Further, as seen in FIG. 2, the privacy screen assemblies 10 can be ganged together in any desired arrangement. In particular, additional screens 12 can be mounted to a single support post 11. For example, FIG. 7 illustrates two screens 12 mounted to two of the eight mounting locations while the opposite ends of the screens 12 are supported by additional support posts 11 as illustrated in FIG. 2. Additional screens 12 also can be mounted in the unused mounting locations where desired. As a result, a plurality of the screens 12 can be mounted to a single support post 11 at angularly spaced mounting locations such that the screens 12 project outwardly from the support post 11 at different angles.

In use, a user is able to subdivide a relatively large office area into smaller workstation areas 15 by arranging one or more divider screen assemblies 10 in any desired configuration. For example in the arrangement illustrated in FIGS. 1 and 2, a central post 11 is provided. This central post 11 includes four separate flexible screens 12 which each have one end connected to one of the eight mounting locations defined by the upper and lower mounting plates 18 and 19. The opposite free ends of the four screens 12 thereby are supported by additional support posts 11 which in the illustrated embodiment are positioned such that the divider screens are oriented perpendicular relative to an adjacent screen 12. While the screens 12 are generally illustrated in a generally linear condition, the screen 12 alternatively may be bowed outwardly by moving the end support post 11 closer to the central support post 11 to vary the shape of the workstations 15.

Still further, one of the support posts 11 also can be provided with an additional divider screen 12' which extends outwardly therefrom and has a free end supported by a still further support post 11 which in the illustrated embodiment is the leftmost post 11 in FIG. 2. However, since the length of the screen 12 extending between the two support posts 11 is to be shorter, the outer tube 17 of the outermost support post 11 is rotated manually to wind up the screen 12' onto the outer periphery thereof. Thus, the office area can be subdivided into any arrangement of workstation areas 15 by suitable placement of the support post 11 and adjustment of the height and lengths of the screens 12.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A divider screen assembly comprising:

first and second elongate upright support posts disposed in spaced apart relation, each of said support posts comprising an inner tube adapted for load-bearing engagement with a floor and a hollow outer tube which is slidably received onto an upper end of said inner tube, said inner tube having a base disposed in freestanding relation with the floor which permits movement of said first and second support posts relative to each other, said outer tube being vertically movable relative to said inner tube, each of said support posts including locking means for fixing the vertical position of said outer tube relative to said inner tube to vary the height of the divider screen assembly, said outer tube of at least one of said support posts being rotatable relative to said inner tube about a generally vertical axis; and a flexible sheet-like screen which is vertically enlarged and extends longitudinally between said first and second support posts, said screen including opposite first and second ends which are connected to said outer tubes of said first and second support posts respectively so as to rotate therewith, said screen being formed of a flexible material such that said screen reversibly wraps about said one support post by rotation of said outer tube thereof and the longitudinal length of said screen between said first and second support posts is adjusted.

2. A divider screen assembly according to claim 1, wherein both of said outer tubes of said first and second support posts are rotatable relative to the respective inner tubes thereof about a generally vertical axis.

3. A divider screen assembly according to claim 1, wherein said flexible screen includes connector means at the opposite ends thereof for removably mounting said screen to said first and second support posts.

4. A divider screen assembly according to claim 3, including at least a second said screen which has a first end thereof fixed to said first support post, said first support post supporting said first-mentioned and second screens thereon, and a third support post, a second end of said second screen being removably connected to said third support post.

5. A divider screen assembly according to claim 4, wherein the length of said first and second screens are independently adjustable by selective manual rotation of said outer tubes of either of said second and third support posts.

6. A divider screen assembly according to claim 4, wherein the lengths of said first and second screens are adjustable by rotation of said outer tube of said first support post relative to said inner tube thereof such that said first and second screens are wound onto said outer tube.

7. A divider screen assembly according to claim 1, wherein said locking means of said first and second support posts supports said outer tubes relative to said inner tubes at different heights.

8. A divider screen assembly according to claim 1, wherein at least said second support tube includes braking means for resisting rotation of said outer tube relative to said inner tube.

9. A divider screen assembly comprising:

a plurality of support posts which are spaced apart one from the other and each includes a base and an upright elongate upper post projecting upwardly therefrom, each of said upper posts including vertically spaced apart upper and lower rings which extend about the outer periphery of said upper post and project outwardly therefrom, each of said upper and lower rings including a plurality of apertures which open vertically therethrough and are angularly spaced apart about said outer periphery of said upper post, each of said apertures of said upper ring corresponding to one of said apertures of said lower ring to define vertically spaced pairs of said apertures which define angularly spaced apart mounting locations, said plurality of support posts comprising first and second support posts; and a flexible sheet-like fabric screen which extends longitudinally between said first and second support posts and is vertically enlarged, said fabric screen including first and second mounting means at opposite first and second ends thereof, each of said first and second mounting means including an upwardly extending projection and a downwardly extending projection which project into a corresponding one of said pairs of said apertures for mounting the respective end of said screen to one of said mounting locations;

each of said upper posts being rotatable relative to said respective base about a substantially vertical rotation axis, said upper post being manually rotatable and said screen being sufficiently flexible so that at least a portion of said screen is wrapped about the outer periphery of said respective upper post to adjust the longitudinal distance between said first and second support posts.

10. A divider screen assembly according to claim 9, wherein said fabric screen is formed from a fabric material which is sufficiently stiff in a vertical direction so as to prevent sagging of said fabric screen in the region between said first and second support posts.

11. A divider screen assembly according to claim 9, wherein a plurality of said screens are provided and said plurality of said posts includes a third support post, a first one of said screens being connected between said first and second support posts, a second one of said screens being connected at said first end thereof to said first support post and at said second end thereof to said third support post by said first and second mounting means thereof, said first screen being connected to said first support post at a first one of said mounting locations and said second fabric screen being connected to said first support post at a second one of said mounting locations which is angularly spaced from said first mounting location.

12. A divider screen assembly according to claim 11, wherein each of said upper posts of said first to third support posts is rotatable relative to said respective base about a substantially vertical rotation axis, said first and second screens being formed of a fabric material which is flexible in a longitudinal direction so as to be rolled onto the outer periphery of said upper tubes upon rotation thereof about said rotation axis to vary the longitudinal length of said first screen between said first and second support posts or said second screen between said first and third support posts, the lengths of said first and second screens being independently adjustable by selective rotation of said upper tubes of said respective second and third support tubes.

13. A divider screen assembly according to claim 12, wherein each of said upper tubes includes adjustment means for adjusting the height of said upper tube relative to said base to adjust the height of said screen attached thereto.

14. A divider screen assembly comprising:

a plurality of vertically elongate upright support posts which are spaced apart one from the other, each of said support posts including a base which is freestanding on a floor to permit movement relative to another of said support posts and an upright elongate upper post projecting upwardly therefrom, said upper post of at least one of said support posts being rotatable relative to said base about a substantially vertical rotation axis, said plurality of support posts comprising at least first and second support posts; and a flexible fabric screen which extends longitudinally between said first and second support posts and is vertically enlarged, said fabric screen including first and second mounting means at opposite first and second ends thereof for mounting the respective ends of said screen to said first and second support posts respectively, said opposite first and second ends of said screen being vertically supported by said first and second support posts with an intermediate screen section between said first and second ends being suspended therebetween, said screen being formed of a fabric which has flexibility at least in a longitudinal direction to permit reversible winding up of said fabric on one of said upper posts during rotation thereof wherein said first and second support posts are movable relative to each other during said winding and which has stiffness at least in a vertical direction to substantially prevent sagging of said intermediate screen section.

15. A divider screen assembly according to claim 14, wherein each of said mounting means includes a rigid vertical support member which extends along a substantial vertical length of said respective first or second end such that said respective first or second end is vertically rigid, said support member being connected to the respective one of said first and second support posts.

16. A divider screen assembly according to claim 15, wherein each of said first and second ends of said screen include a hemmed section which extends vertically along an end edge of said screen and opens vertically from upper and lower ends thereof, each of said hemmed sections including one said support member therein such that said end edge is rigid.

17. A divider screen assembly according to claim 16, wherein said support member has upper and lower ends which respectively project upwardly and downwardly from said hemmed section and are secured to said respective first or second support post.

18. A divider screen assembly according to claim 15, wherein said screen is pivotally connected to said support member so as to be swingable about a substantially vertical pivot axis.

19. A divider screen assembly according to claim 18, wherein a plurality of said screens are mounted to said first support post so as to extend radially therefrom.

* * * * *